US005247720A

United States Patent [19]

Sovis et al.

[11] Patent Number: 5,247,720

[45] Date of Patent: Sep. 28, 1993

[54] VALVING STRUCTURE FOR AIR PASSAGEWAYS OF FLOOR NOZZLE AND AUXILIARY INLET OF A VACUUM CLEANER

[75] Inventors: John F. Sovis, Twinsburg; James J. Kopco, Mentor-on-the-Lake; Paul D. Stephens, Cleveland Heights; Michael F. Wright, Cuyahoga Falls, all of Ohio

[73] Assignee: Royal Appliance Mfg. Co., Cleveland, Ohio

[21] Appl. No.: 819,472

[22] Filed: Jan. 10, 1992

[51] Int. Cl.[5] ..... A47L 5/00

[52] U.S. Cl. ..... 15/334; 251/303

[58] Field of Search ..... 15/331-334; 251/297, 298, 303

[56] References Cited

U.S. PATENT DOCUMENTS

| | | | |
|---|---|---|---|
| 2,046,684 | 7/1936 | Hoover . | |
| 2,070,689 | 2/1937 | Smellie . | |
| 2,072,696 | 3/1937 | Whitaker | 15/332 |
| 2,156,805 | 5/1939 | Dow | 15/334 |
| 2,218,035 | 10/1940 | Benson | 15/332 |
| 2,219,911 | 10/1940 | Wells | 15/331 |
| 2,333,494 | 11/1943 | Snyder | 15/333 |
| 2,624,064 | 1/1953 | Snyder . | |
| 2,664,587 | 1/1954 | Kitto | 15/333 |
| 2,668,314 | 2/1954 | Segesman | 15/333 |
| 3,268,202 | 8/1966 | Murray et al. | 251/303 |
| 3,588,945 | 6/1971 | Krier et al. | 15/332 |
| 3,879,797 | 4/1975 | Principe et al. | 15/334 |
| 4,376,322 | 3/1983 | Lockhart et al. | 15/323 |

FOREIGN PATENT DOCUMENTS

| | | | |
|---|---|---|---|
| 62413 | 6/1955 | France | 251/303 |
| 1099168 | 6/1984 | U.S.S.R. | 251/298 |
| 414601 | 8/1934 | United Kingdom | 15/334 |
| 1173013 | 12/1969 | United Kingdom | 15/333 |

*Primary Examiner*—Harvey C. Hornsby
*Assistant Examiner*—Mark Spisich
*Attorney, Agent, or Firm*—Fay, Sharpe, Beall, Fagan, Minnich & McKee

[57] ABSTRACT

A suction cleaner includes a floor nozzle and a handle pivotally connected to the floor nozzle. A suction creating device is located in one of the handle and the floor nozzle and a filter bag is secured to the handle. A first passageway leads from the floor nozzle to the filter bag. A first valve member is located in the first air passageway. A cleaning tool hose is secured to the handle. A second air passageway leads from the cleaning tool hose to a filter bag. A second valve member is located in the second air passageway.

19 Claims, 7 Drawing Sheets

VALVING STRUCTURE FOR AIR PASSAGEWAYS OF FLOOR NOZZLE AND AUXILIARY INLET OF A VACUUM CLEANER

BACKGROUND OF THE INVENTION

The present invention relates to vacuum cleaners. More particularly, the instant invention relates to improvements in the nozzle structure of a convertible vacuum cleaner which can be utilized for either on the floor cleaning or off the floor cleaning as desired.

Many vacuum cleaners heretofore developed and presently available are capable of both on the floor cleaning and above the floor cleaning. Such convertible vacuum cleaners usually employ a suction generating fan and some sort of valve for controlling the application of the suction developed by the fan either to a floor nozzle or to an auxiliary suction inlet located on the housing of the cleaner. One end of the flexible suction hose is generally attached to such a suction inlet. The opposite end of the hose is usually adapted to receive one of a variety of tools suited for above the floor cleaning such as brushes, wands and the like.

While the suction control valves utilized in such convertible cleaners are generally capable of performing their intended function, some have not proven to be entirely satisfactory. Most of the known devices utilize a single valve for regulating the flow of air through both a first air passageway leading from the floor nozzle to a filter bag and a second air passageway leading from the auxiliary suction inlet to the filter bag. The use of a single valve to perform both functions may not always be advisable. Also, the valve would sometimes jam disabling the vacuum cleaner and necessitating the disassembly of the vacuum cleaner to repair the valve.

In addition to the aforementioned problems, many of the convertible vacuum cleaners are objectionable from the standpoint that considerable time and effort is required to convert from on the floor cleaning to off the floor cleaning and vice versa. One of the reasons for this is that the cleaning tool hose utilized on some of the cleaners needs to be detached from the cleaner when not in use and is oftentimes stored at a location remote from the cleaner itself.

In order to solve this problem, some cleaners allow for storage of the cleaning tool hose directly on the vacuum cleaner. Such cleaners usually have one end of the hose permanently secured to the auxiliary suction inlet in the housing.

While cleaners of this type did eliminate the inconvenience of storing the cleaning tool hose at a location remote from the vacuum cleaner, many of these cleaners are cumbersome to use and store due to the construction of the handle of the cleaner and the manner in which the cleaning tool hose was secured to the vacuum cleaner when not in use. In addition, sometimes a clogging of the auxiliary suction inlet or the cleaning tool hose would occur. This caused a problem for those vacuum cleaners in which the hoses were permanently secured to the auxiliary inlet of the vacuum cleaner.

Accordingly, it has been considered desirable to develop a new and improved convertible vacuum cleaner which would overcome the foregoing difficulties and others while providing better and more advantageous overall results.

BRIEF SUMMARY OF THE INVENTION

In accordance with the present invention, a suction cleaner is provided.

More particularly in accordance with this aspect of the invention, the suction cleaner comprises a floor nozzle and a handle pivotally connected to the floor nozzle. A suction creating means is located in one of the handle and the floor nozzle and a filter bag is secured to the handle. A first air passageway leads from the floor nozzle to the filter bag and a first valve member is located in the first air passageway. A cleaning tool hose is secured at one end to an auxiliary inlet located on one of the floor nozzle and the handle. A second air passageway leads from the auxiliary inlet to the filter bag and a second valve member is located in the second air passageway.

According to another aspect of the invention, an upright suction cleaner is provided which can be moved about over a surface being cleaned for on the floor cleaning and off the floor cleaning.

More particularly in accordance with this aspect of the invention, the cleaner comprises a floor nozzle and a handle pivotally connected to the floor nozzle, the handle including a motor housing portion. A motor and fan unit are mounted in the motor housing portion of the handle A filter bag is secured to the handle and an agitator is rotatably mounted in the floor nozzle and driven by the motor and fan unit. A first suction flow path leads from the floor nozzle to the filter bag. A cleaning tool hose is connected at one end to the handle A second suction flow path leads from the cleaning tool hose to the filter bag. A first valve is located in the first suction flow path for selectively sealing the first suction flow path. A second valve is located in the second suction flow path for selectively sealing the second suction flow path.

According to still another aspect of the invention, a suction cleaner is provided.

More particularly in accordance with this aspect of the invention, the suction cleaner comprises a nozzle body including a suction inlet and a handle pivotally connected to the nozzle body. A suction creating means is located in one of the handle and the nozzle body and a filter bag is secured to the handle. A first air passageway leads from the suction inlet to the filter bag. A first valve member is located in the first air passageway. The first valve member comprises a shaft pivoted in the floor nozzle, a sleeve rotatably secured to the shaft, a valve element fixedly secured to the shaft and a first spring for resiliently biasing the shaft in a first direction. A means is provided for selectively pivoting the first valve member to a closed position. A cleaning tool hose is secured at a first end to an auxiliary suction inlet located on one of the nozzle body and the handle. A second air passageway leads from the auxiliary suction inlet to the filter bag and a second valve member is located in the second air passageway.

One advantage of the present invention is the provision of a new and improved convertible vacuum cleaner.

Another advantage of the present invention is the provision of a convertible vacuum cleaner which is low in cost and easy to manufacture but is sturdy and is capable of withstanding prolonged use.

Still another advantage of the present invention is the provision of a convertible vacuum cleaner which enables both on the floor cleaning operations, with the aid of a rotating brush, as well as above the floor cleaning operations and can be readily switched from one operation to the other.

Yet another advantage of the present invention is the provision of a convertible vacuum cleaner which employs an overload means on a valve that closes a passageway leading from a floor nozzle to a filter bag.

A further advantage of the present invention is the provision of a convertible vacuum cleaner which employs two separate valve members including a first valve member which selectively allows a flow of air through a first passageway leading from a floor nozzle to a filter bag and a second valve member which selectively allows a flow of air through a second passageway leading from an auxiliary suction inlet to the filter bag.

A still further advantage of the present invention is the provision of a vacuum cleaner having a valve member which automatically closes an air passageway leading from a suction inlet of a floor nozzle to a filter bag upon a pivoting movement of the vacuum cleaner to an upright position.

A yet further advantage of the present invention is the provision of a vacuum cleaner in which a manually operated valve member is provided for selectively closing a second air passageway leading from an auxiliary suction inlet to a filter bag.

An additional advantage of the present invention is the provision of a vacuum cleaner in which a tool hose that is secured at a first end to an auxiliary suction inlet of the vacuum cleaner can be selectively detached therefrom. Preferably, the second end of the tool hose can be held in a storage sleeve provided on the vacuum cleaner.

Still other benefits and advantages of the invention will become apparent to those skilled in the art upon a reading and understanding of the following detailed specification.

BRIEF DESCRIPTION OF THE DRAWINGS

The invention may take form in certain parts and arrangement of parts a preferred embodiment of which will be illustrated in the accompanying drawings which form a part hereof and wherein.

DETAILED DESCRIPTION OF THE PREFERRED EMBODIMENT

Figure 1:
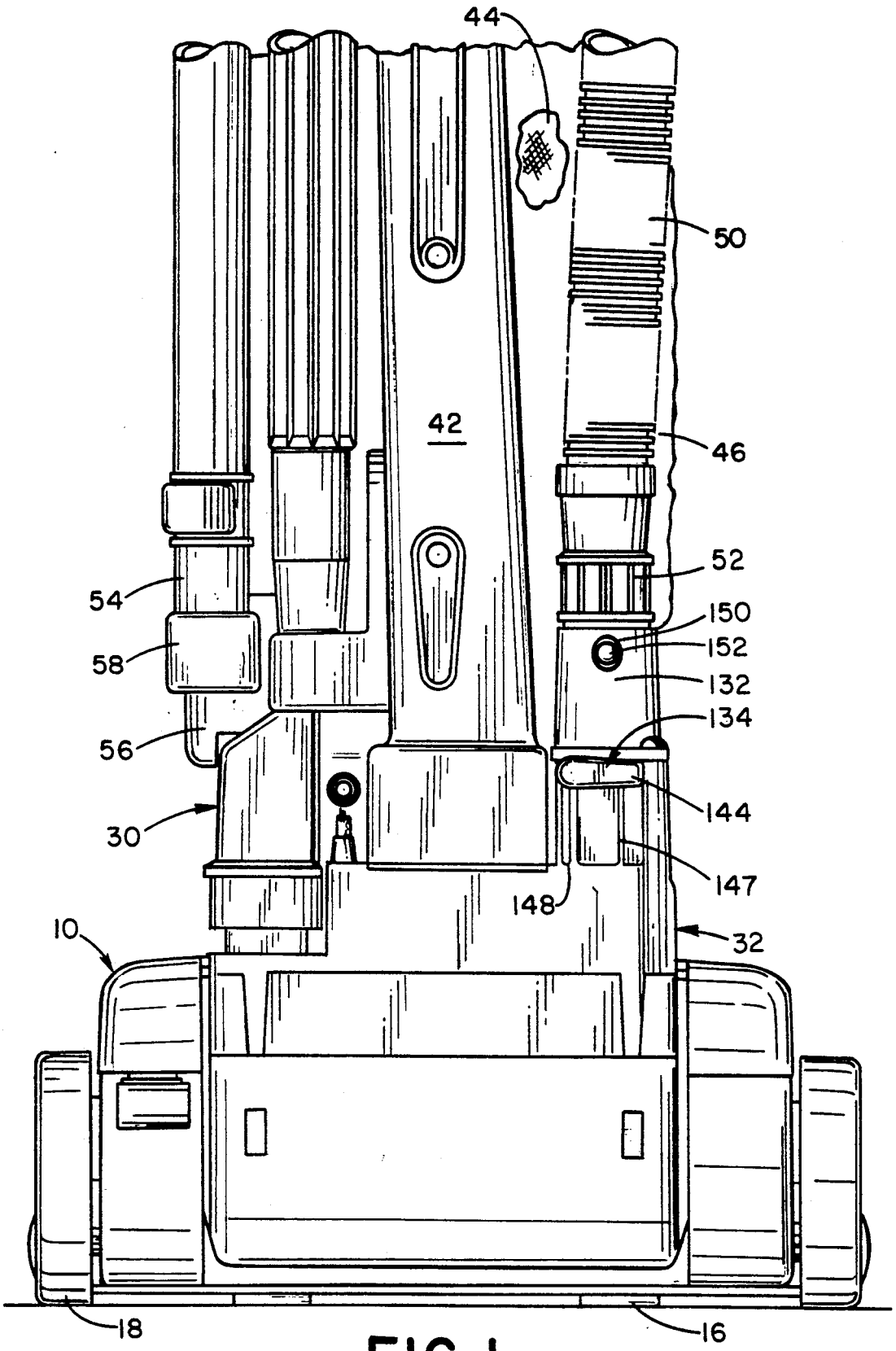
FIG. 1 is a rear elevational view of a lower portion of the convertible vacuum cleaner according to the preferred embodiment of the present invention.

Referring now to the drawings, wherein the showings are for purposes of illustrating a preferred embodiment of the invention only and not for purposes of limiting same, FIG. 1 shows the subject new vacuum cleaner A. While the valving structure illustrated is primarily designed for and will hereinafter be described in connection with a specific type of convertible vacuum cleaner, it should be appreciated that several of the features disclosed herein can be adapted for use in many different types of convertible vacuum cleaners as well as other types of vacuum cleaners.

Figure 3:
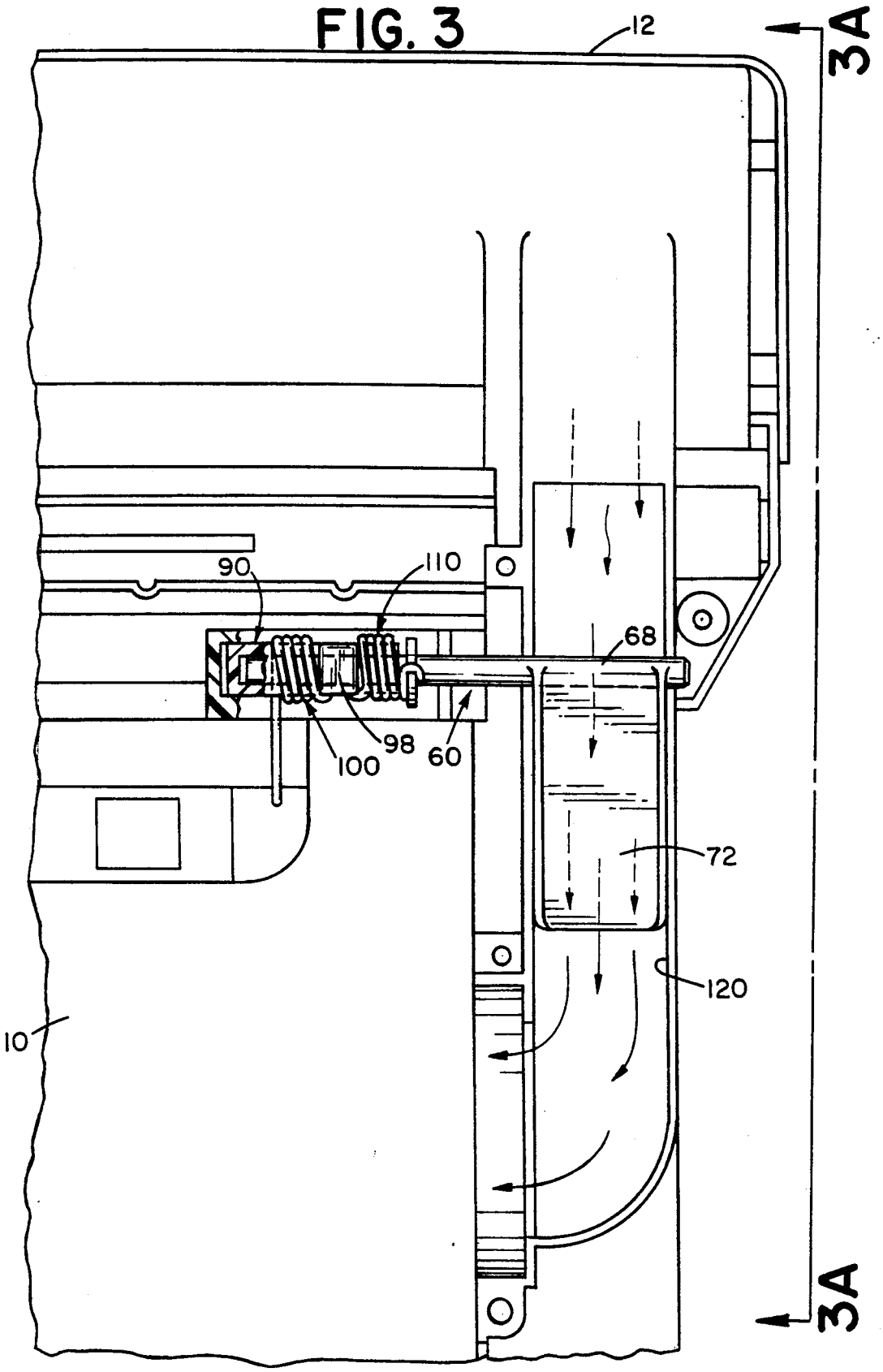
FIG. 3 is an enlarged top plan view of a portion of a disassembled nozzle base of the vacuum cleaner of FIG. 1.
Figure 3A:
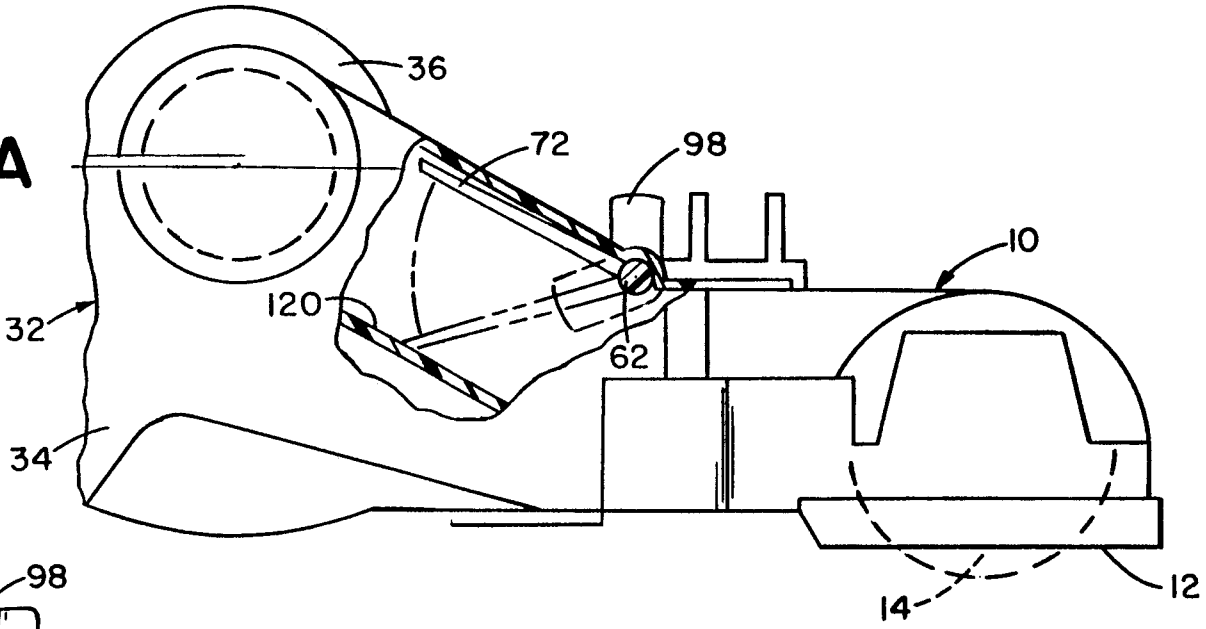
FIG. 3A is a side elevational view, partially broken away, of the nozzle base of FIG. 3 along line 3A—3A.

With reference also to FIG. 3A, the vacuum cleaner A includes a nozzle base 10 containing a suction inlet 12 which defines a brush chamber. Mounted therein is a rotatable brush 14. Supporting the nozzle base on a subjacent surface are a pair of first wheels 16 and a pair of second wheels 18.

Rotatably mounted on the nozzle base 10 is a handle 30. The handle includes at its lower end a motor housing 32 comprising a first motor shell 34 and a second motor shell 36 which cooperate to define between them a motor chamber 38. The chamber holds a suitable conventional vacuum cleaner motor and fan unit 40. The handle 30 also includes a hollow lower portion 42 which terminates in a discharge opening (not visible in FIG. 1). Secured over the discharge opening is a suitable filter bag 44 which is enclosed in a cloth bag 46. The handle further includes an upper portion (not visible in FIG. 1) which is meant to be grasped by an operator of the vacuum cleaner.

Also provided for the vacuum cleaner is a cleaning tool hose 50 which has a first end 52 and a second end 54. Secured to the handle 30 is a bag support 56 which has, among other things, a storage sleeve 58 into which the second end 54 of the cleaning tool hose 50 can be selectively secured when the hose is not in use.

Figure 4:
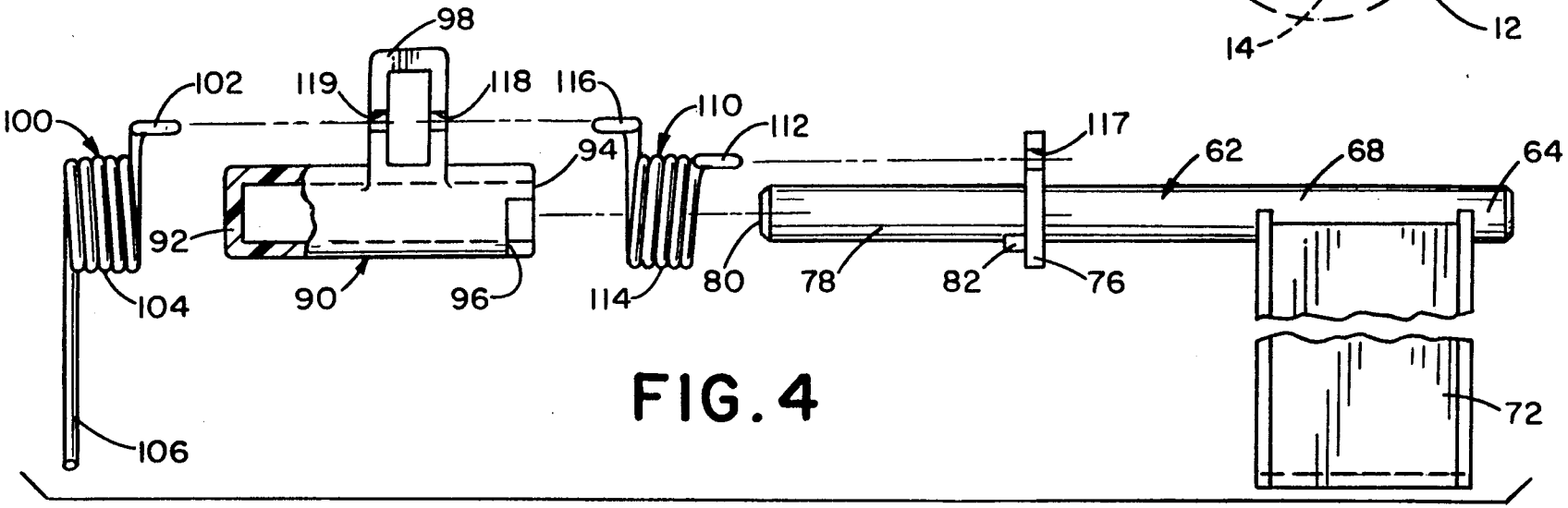
FIG. 4 is an enlarged exploded top plan view of a suction nozzle door assembly of the nozzle base shown in FIG. 3.

With reference now to FIG. 3, a first valve 60 is provided in the vacuum cleaner for selectively blocking the suction inlet 12 from the suction motor held in the motor chamber 38 and the filter bag. With reference also to FIG. 4, the first valve comprises a shaft 62 having a first end 64. Extending from the first end 64 is a first shaft section 68. Located on the first shaft section 68 is a valve element 72. The first shaft section terminates in a flange 76. Extending beyond the flange 76 is a second shaft section 78 which terminates in a second end 80 of the shaft 62. Provided on the flange 76, and extending partially around the circumference of the shaft 62 at that point, is a tab area 82.

Slipped onto the second end 80 of the shaft 62 is a sleeve 90. The sleeve has a closed first end 92 and an open second end 94. Extending partially around the circumference of the open second end 94 is a cutout area 96 which is meant to cooperate with the tab section 82 of the shaft 62. Located on an outer periphery of the sleeve 90 and extending away therefrom is a lever arm 98.

Slipped over the sleeve 90 is a return spring 100 which has a first end 102, a coiled center portion 104 and a second end 106. Positioned on the shaft 62 is an overload spring 110 having a first end 112, a coiled central portion 114 and a second end 116. The overload spring 110 is positioned on the second section 78 of the shaft 62 such that it is located between the flange 76 and the sleeve 90.

Figure 6:
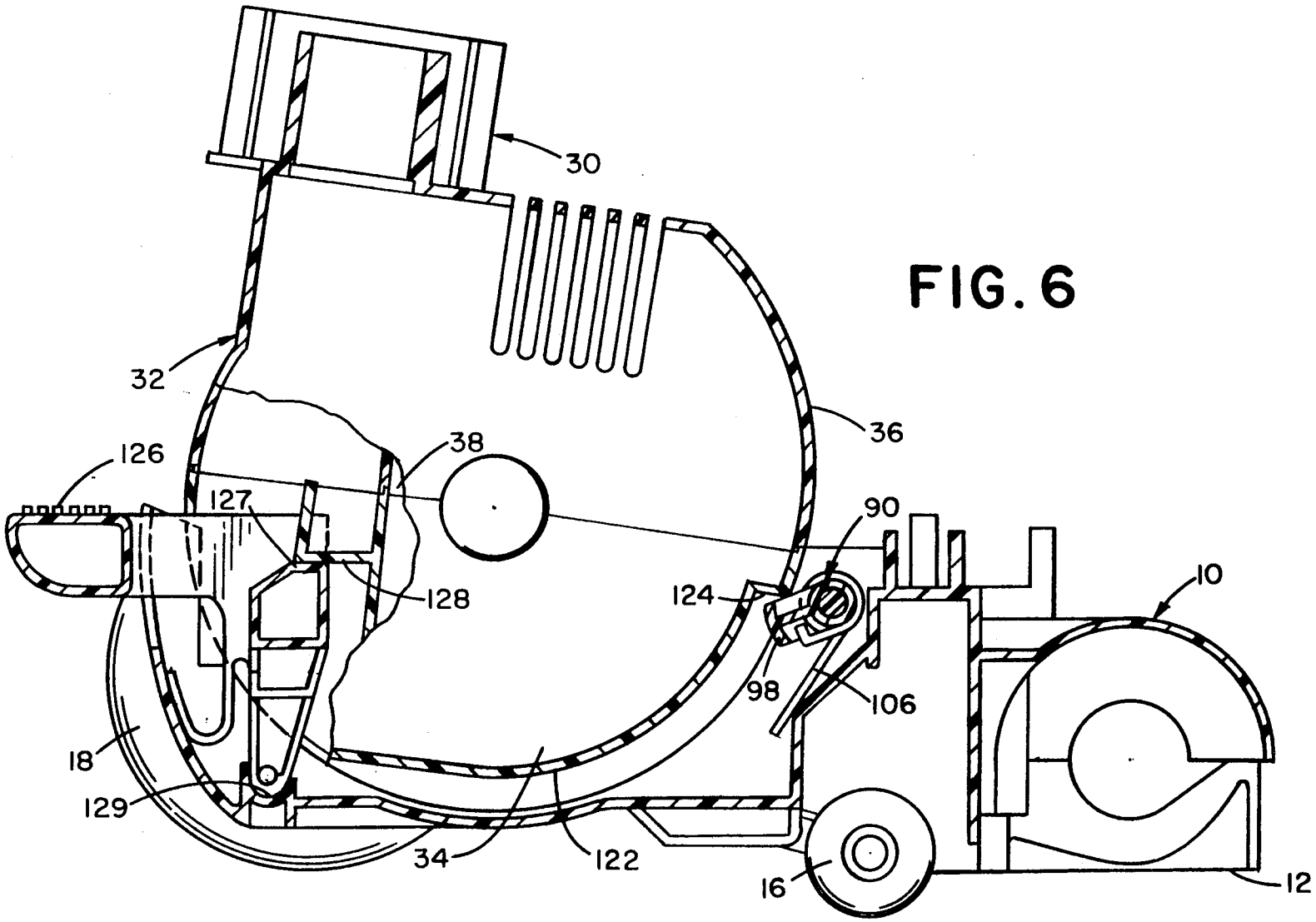
FIG. 6 is a side elevational view, in cross section and partially broken away, of a portion of the vacuum cleaner of FIG. 1; and, FIG. 7 is a side elevational view, partially broken away and in cross section, of the vacuum cleaner of FIG. 1.

The first end 112 of the overload spring is seated in a groove 117 located in the flange 76 of the shaft 62. The second end 116 of the overload spring 110, as well as the first end 102 of the return spring 100 are located in spaced grooves 118 and 119, respectively, positioned on a lower surface of the lever arm 98. The second end 106 of the return spring 100 contacts a portion of the nozzle base 10 as is best seen in FIGS. 3 and 6.

Figure 5:
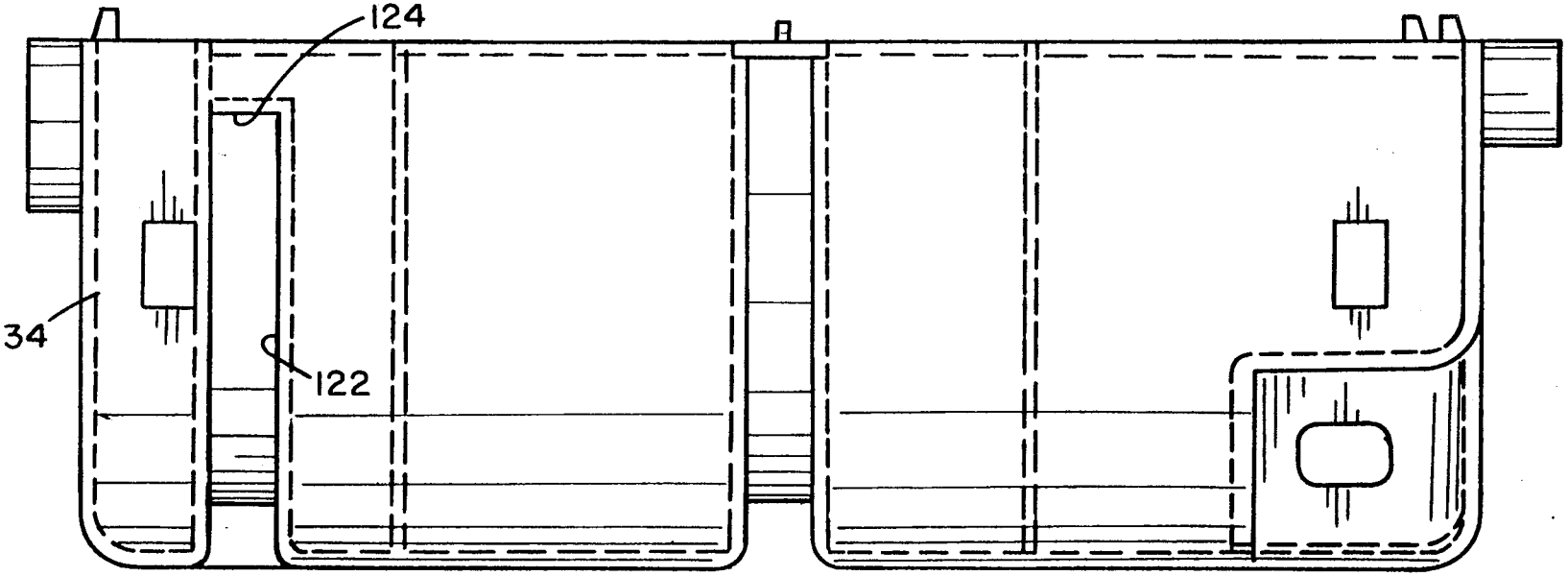
FIG. 5 is an enlarged front elevational view of a lower motor housing of the vacuum cleaner of FIG. 1.

As shown in FIG. 3, a first air passageway 120 leads from the suction inlet 12 to the discharge opening and passes through the motor chamber 38. In order to actuate the first valve 60 to block the passageway 120, the lever 98 needs to be contacted so as to pivot the sleeve 90, and hence the shaft 62 in relation to the nozzle base 10. Such pivoting will take place when the handle 30 is moved to an upright position in relation to the nozzle base 10. To this end, a groove 122 is located in the first motor shell half 34 as shown in FIGS. 5 and 6. An end wall 124 of the groove 122 will contact the lever 98 thereby rotating the sleeve 90 and hence the shaft 62. Such rotation will take place since the cutout 96 of the sleeve 90 will cooperate with the tab 82 of the shaft 62.

If an obstruction is encountered by the valve element 72, the overload spring 110 comes into play. When the handle 30 is raised to the upright position and the groove end wall 124 contacts the lever 98 thereby rotating the sleeve 90 and the shaft 62, the valve element 72 will be urged to move in such a way as to close the first air passageway 120, as shown in dotted lines in FIG. 3A. However, should a blockage be encountered in the passageway, the overload spring 110 will allow a continued rotation of the sleeve 90 without a corresponding continued rotation of the shaft 62 since such rotation of the shaft and the valve element 72 is blocked by the obstruction which has been encountered by the valve element. In addition, the overload spring is advantageous because it allows the valving assembly 60 to compensate for any tolerance errors in the dimensions of the several components thereof.

When the handle 30 is again lowered, i.e. pivoted backwardly away from the perpendicular in relation to the nozzle base 10, the groove end wall 124 will no longer be in contact with the lever 98. At this point, the return spring 100 will bias the shaft 62 so as to rotate it counterclockwise thereby raising the valve element 72 away from its blocking position in the first air passageway 120, as shown in FIG. 3A.

As shown in FIG. 6, a foot operated lever 126 is utilized to lock the handle structure 30 in the upright position in relation to the floor nozzle 10. The foot lever 126 includes a portion 127 which cooperates with a wall 128 of the motor shell 32 to lock the handle in the upright position. When the pedal 126 is pivoted on surface 129 of the floor nozzle 10, its section 127 is retracted back away from the wall 128 thereby allowing the handle structure 30 to rotate counterclockwise. As mentioned, this, in turn, allows the lever 98, the sleeve 90 and the shaft 62 to rotate so as to open the passageway 120.

Figure 2A:
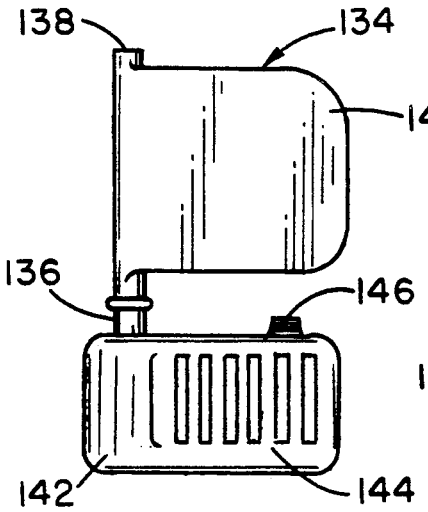
FIG. 2A is a top plan view of a valve element of FIG. 2.
Figure 2:
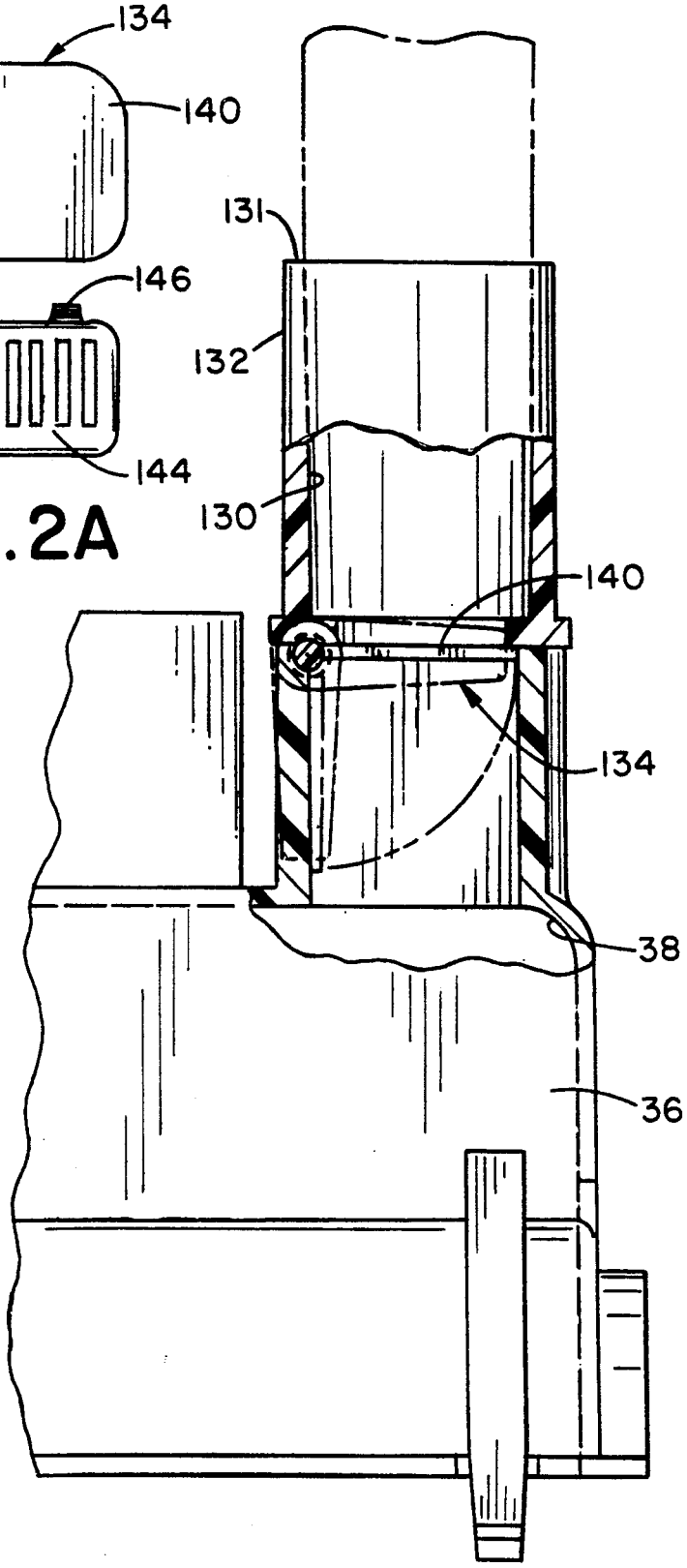
FIG. 2 is an enlarged rear elevational view, partially broken away, of a portion of the vacuum cleaner of FIG. 1.
Figure 7:
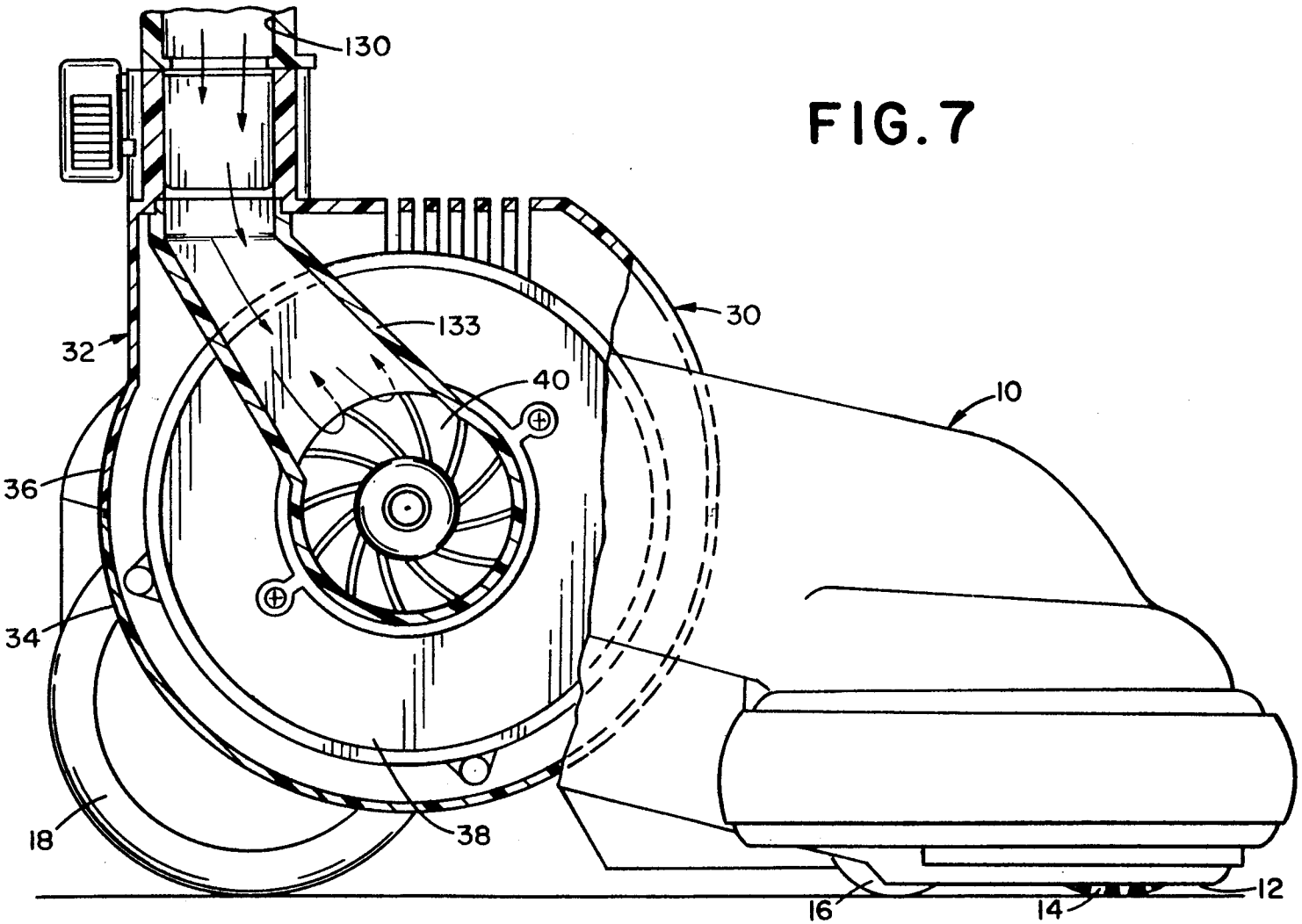

With reference now to FIG. 2, communicating with the first passageway 120 is a second passageway 130 which extends from an auxiliary inlet 131 defined by a stub 132 secured to the second motor shell 36. As shown in FIG. 7, the second air passageway 130 communicates with the first air passageway 120 through an inlet member 133 that extends into the motor chamber 38 and encircles a fan portion of the motor and fan unit 40. Located in the second air passageway 130 is a second valve 134. As shown in FIG. 2A the second valve comprises a shaft 136 which is pivotally mounted on the first motor shell 34. Located on a first end 138 of the shaft is a door element 140. Located on a second end 142 of the shaft is a door lever 144. When the suction inlet 12 of the vacuum cleaner A is in communication with the filter bag, i.e. when the handle 30 is inclined in relation to the nozzle base 10, the second valve 134 is closed.

The second valve 134 can be held in either end position by means of a lock construction including a button 146, shown in FIG. 2A, located on an inner face of the lever 144. The button 146 cooperates with the top of a ridge 147 located on the outer surface of the second motor shell 36 as shown in FIG. 1 and with a groove 148 which is spaced from the ridge 147. That is, when the valve is in the closed position as is illustrated in FIG. 1, the button 146 rests atop the ridge 147 and thereby prevents an inadvertent movement of the valve 134. When, on the other hand, the valve 134 is in the open position as is illustrated in dashed lines in FIG. 2, the button 146 will be seated in the groove 148. This will hold the lever 144 in the lower position as is illustrated in dashed lines in FIG. 2 until the lever 144 is again positively moved.

When the handle 30 is raised to the upright position, the suction inlet 12 is cut off from the filter bag 44. This is when the cleaning tool hose 50 is meant to be used. For this purpose, the second end 54 of the hose is removed from the storage sleeve 58 on the bag support 56. Simultaneously therewith, the second valve 134 can be opened. As shown in FIG. 2, this can be done by pivoting the door lever 144 so that it rotates clockwise approximately 90 degrees in relation to the motor housing 32. The second valve door element 140 will, therefore, adopt a position parallel to the stub wall rather than perpendicular thereto thereby allowing a free flow of air through the stub 132. Now a suitable cleaning tool (not illustrated) can be attached to the second end 54 of the cleaning tool hose, after it is removed from the storage sleeve 58, so as to enable the vacuum cleaner operator to perform above the floor cleaning chores.

When it is again desired to utilize the vacuum cleaner for on the floor cleaning, one need merely return the second end 54 of the cleaning tool hose back into the storage sleeve 58, after the suitable cleaning tool has been removed therefrom. Thereafter, one can pivot the second valve 134 by rotating the door lever 144 until the door element 140 assumes a position perpendicular to the walls of the stub 132 thereby blocking any further air flow through the cleaning tool hose 50, as shown in solid lines in FIG. 2.

With reference again to FIG. 1, a means for selectively securing the first end 52 of the cleaning tool hose to the handle 30 can also be provided. For this purpose, the stub 132 can include a suitable aperture 150. Adapted to extend through this aperture is a resiliently biased button 152 located on the first end 52 of the cleaning tool hose 50. When the button 152 extends through the aperture 150 the hose 50 is locked to the stub 132. Detaching the hose 50 may be necessary if the operator needs to clean out either the hose itself or the second air passageway adjacent the hose. In other words, it is easier to unclog the hose and the second air passageway because the hose is removeable. When it is desired to detach the hose 50, the button 150 is merely depressed so as to allow removal of the hose first end 52 from the stub 132.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

What is claimed is:

1. A suction cleaner comprising:
a floor nozzle;
a handle pivotally connected to said floor nozzle;
a suction creating means located in one of said handle and said floor nozzle;
a filter bag secured to said handle;
a first air passageway leading from said floor nozzle to said filter bag;
a first valve member located in said first air passageway wherein said first valve member comprises:
a shaft pivotally mounted in said floor nozzle,
a sleeve mounted on said shaft for limited rotation and including means for engaging said shaft and rotating same,
a valve element fixedly secured to said shaft, and
a first spring engaging said sleeve on one end for resiliently biasing said sleeve and hence said shaft in a first direction;
a cleaning tool hose secured at one end to an auxiliary inlet located on one of said floor nozzle and said handle;
a second air passageway leading from said auxiliary inlet to said filter bag; and,
a second valve member located in said second air passageway.

2. The suction cleaner of claim 1 wherein said first valve member further comprises a second spring engaging said shaft on one end and said sleeve on another end for biasing said sleeve in a first direction.

3. The suction cleaner of claim 1 wherein said auxiliary inlet is located on said handle and wherein said second valve member comprises;
a shaft pivotally mounted to said handle;
a door element secured to a first end of said shaft; and,
a lever secured to a second end of said shaft.

4. The suction cleaner of claim 3 further comprising a means for securing said door element in a sealing relationship in said second flow passage.

5. The suction cleaner of claim 1 further comprising a means for selectively pivoting said first valve member to a closed position.

6. The suction cleaner of claim 5 wherein said means for pivoting comprises:
a lever operatively secured to said first valve member; and,
a portion of said handle which, when said handle is pivoted to an upright position, will contact said lever to rotate said lever and thus said first valve member to seal said first flow path.

7. The suction cleaner of claim 1 wherein a first end of said cleaning tool hose is sealingly secured to said handle and further comprising a means for storing a second end of said cleaning tool hose.

8. The suction cleaner of claim 1 further comprising a means for selectively securing a first end of said cleaning tool hose to said handle.

9. An upright suction cleaner which may be moved about over a surface being cleaned for on the floor cleaning and off the floor cleaning, the cleaner comprising:
a floor nozzle;
a handle pivotally connected to said floor nozzle, said handle including a motor housing portion;
a motor and fan unit mounted in said motor housing portion of said handle;
a filter bag secured to said handle;
an agitator rotatably mounted in said floor nozzle and driven by said motor and fan unit;
a first suction flow path leading from said floor nozzle to said filter bag;
a cleaning tool hose connected at one end to said handle;
a second suction flow path leading from said cleaning tool hose to said filter bag;
a first valve located in said first suction flow path for selectively sealing said first suction flow path;
a second valve located in said second suction flow path for selectively sealing said second suction flow path; and,
a means for pivoting said first valve to a closed position, wherein said means for pivoting comprises:
a lever operatively secured to said first valve, and
a portion of said handle which, when said handle is pivoted to an upright position, will rotate said lever and said first valve to seal said first flow path.

10. The suction cleaner of claim 9 wherein said first valve member comprises:
a shaft pivoted in said floor nozzle;
a sleeve rotatably secured on said shaft;
a valve element fixedly secured to said shaft;
a first spring for resiliently biasing said sleeve in a first direction; and,
a second spring for biasing said sleeve in a first direction.

11. The suction cleaner of claim 9 wherein said second valve member comprises:
a shaft pivotally mounted to said handle;
a door element secured to a first end of said shaft; and,
a door lever secured to another end of said shaft.

12. A suction cleaner comprising:
a nozzle body including a suction inlet;
a handle pivotally connected to said body;
a suction creating means located in one of said handle and said body;
a filter bag secured to said handle;
a first air passageway leading from said suction inlet to said filter bag;
a first valve member located in said first air passageway, wherein said first valve member comprises:
a shaft pivoted in said floor nozzle,
a sleeve mounted on said shaft, wherein said sleeve is allowed to rotate a limited amount in relation to said shaft,
a valve element fixedly secured to said shaft,
a return spring for resiliently biasing said sleeve in a first direction;
an overload spring for resiliently biasing said sleeve in a first direction;
a means for selectively pivoting said first valve member to a closed position; and,
a cleaning tool hose secured at a first end to an auxiliary suction inlet located on one of said nozzle body and said handle.

13. The suction cleaner of claim 12 further comprising:

a second air passageway leading from said auxiliary suction inlet to said filter bag; and, a second valve member located in said second air passageway.

14. The suction cleaner of claim 13 wherein said second valve member comprises:

a shaft pivotally mounted to said handle;

a door element secured to a first end of said shaft; and, a door lever secured to another end of said shaft.

15. The suction cleaner of claim 14 further comprising a means for securing said door element in a sealing relationship in said second flow passage.

16. The suction cleaner of claim 12 further comprising a means for storing a second end of said cleaning tool hose.

17. The suction cleaner of claim 12 wherein said means for pivoting comprises:

a lever secured to said sleeve;

a portion of said handle which, when said handle is pivoted to an upright position, will rotate said lever and said first valve to seal said first flow path.

18. The suction cleaner of claim 17 wherein said portion of said handle comprises;

a motor housing secured to a lower end of said handle;

a groove extending peripherally around said motor housing; and, a wall terminating said groove.

19. The suction cleaner of claim 17 further comprising a means for selectively locking said handle in an upright position in relation to said floor nozzle when said floor nozzle is supported on a subjacent surface.

* * * * *

UNITED STATES PATENT AND TRADEMARK OFFICE

CERTIFICATE OF CORRECTION

PATENT NO. : 5,247,720

DATED : September 28, 1993

INVENTOR(S) : John F. Sovis, et al.

It is certified that error appears in the above-identified patent and that said Letters Patent is hereby corrected as shown below:

Claim 12, column 8, line 60, delete "sleeve" and substitute therefor --shaft--; and,
line 61, delete " ; " and substitute therefor --, and--.

Signed and Sealed this

Twenty-ninth Day of March, 1994

Bruce Lehman

*Attest:*

BRUCE LEHMAN

*Attesting Officer*

*Commissioner of Patents and Trademarks*